United States Patent [19]

Tinsley

[11] Patent Number: 4,645,006

[45] Date of Patent: Feb. 24, 1987

[54] ANNULUS ACCESS VALVE SYSTEM

[76] Inventor: Paul J. Tinsley, 2300 Crestmont, Norman, Okla. 73069

[21] Appl. No.: 679,288

[22] Filed: Dec. 7, 1984

[51] Int. Cl.[4] ..... E21B 21/10; E21B 34/14

[52] U.S. Cl. ..... 166/374; 166/318; 166/386; 175/234; 175/237; 175/317; 175/324

[58] Field of Search ..... 166/373, 374, 312, 386, 166/154, 155, 301, 318, 320, 321, 325; 175/317, 324, 237, 65, 57, 320, 234, 231; 251/122, 339; 137/881

[56] References Cited

U.S. PATENT DOCUMENTS

| | | | |
|---|---|---|---|
| 2,128,352 | 8/1938 | Creighton | 175/65 |
| 2,249,511 | 7/1941 | Westall | 166/289 |
| 2,312,018 | 2/1943 | Beckman | 175/237 |
| 2,312,789 | 3/1943 | Appleby | 175/237 |
| 2,380,022 | 7/1945 | Burt . | |
| 2,394,759 | 2/1946 | Edwards | 166/318 |
| 2,723,677 | 11/1955 | Middleton et al. | 137/270 |
| 2,765,146 | 10/1956 | Williams, Jr. | 175/324 |
| 2,855,952 | 10/1958 | Tausch et al. | 137/508 |
| 3,542,130 | 11/1970 | Stout | 166/318 |
| 3,799,278 | 3/1974 | Oliver | 175/317 |
| 3,802,521 | 4/1974 | Oliver | 175/318 |
| 3,848,670 | 11/1974 | Pitts | 166/224 |
| 4,406,335 | 9/1983 | Kott | 175/317 |

*Primary Examiner*—James A. Leppink
*Assistant Examiner*—Hoang C. Dang
*Attorney, Agent, or Firm*—Laney, Dougherty, Hessin & Beavers

[57] ABSTRACT

An annulus access valve system having a plurality of valves installed in, and forming a part of, a drill string in a well bore whereby fluid may be pumped into the annulus through the valves individually or in combination as desired. Each valve has a valve body connected to the drill string in which defines a longitudinal opening therethrough and a transverse port therein interconnecting the longitudinal opening with the annulus. A longitudinally slidable valve seats on a replaceable valve seat defining a closed position of the transverse port in the valve. The valve sleeve is biased in the closed position by a spring. An actuator, uniquely sized for a specific valve in the drill string, is utilized to engage the valve sleeve and move it to an open position by hydraulic pressure applied thereabove so that fluids may be pumped down the drill string through the transverse port into the annulus. A flow control valve is positioned in the actuator so that some fluid may be directed therebelow as desired. A method of utilizing the annulus access valve system for preventing blowouts in wells is disclosed, along with other methods of use.

17 Claims, 3 Drawing Figures

ANNULUS ACCESS VALVE SYSTEM

BACKGROUND OF THE INVENTION

1. Field Of The Invention

This invention relates to systems for obtaining access to the annulus between a well bore and a drill string herein, and particularly to a system with a plurality of valves installed in, and forming a part of, the drill string including the drill collar, whereby fluid may be pumped into the annulus as desired and which is useful for such purposes as controlling a high pressure area in the well bore resulting from the entry of high pressure formation fluid, such as a liquid or gas, into the well, a situation commonly referred to as a "kick". The valve configuration is designed for use in the drill string, but is not limited to such usage.

2. Description Of The Prior Art

Most previous downhole valves relate to cementing procedures and are not part of the drill string. An example is the apparatus of Burt, U.S. Pat. No. 2,380,022. In Burt, a plurality of valves are mounted in a conduit string such as casing or production tubing. A single manipulative device is utilized for controlling said valves. Another valve assembly usable for cementing purposes is that of Pitts, U.S. Pat. No. 3,848,670 which also utilizes a sliding valve. Still another cementing apparatus installed in the casing is shown in U.S. Pat. No. 2,249,511 to Westall.

U.S. Pat. No. 2,855,952 to Tausch et al. discloses a valve used for well stimulation and workover operations. Tausch et al. has a sliding valve member which is returned to its original position by a spring, but has a totally different opening arrangement from the valve system of the present invention.

The valve of Middleton et al., U.S. Pat. No. 2,723,677, is installed in a well string, unlike the drill string installation of the present invention, and is used for control of fluids through the well string.

SUMMARY OF THE INVENTION

The present invention is a system for providing access to the annulus between a well bore and a drill string therein whereby fluid may be pumped into the annulus as desired. The system includes a plurality of valves spaced along the drill string including the drill collar, forming a portion thereof, with each of the valve providing means for access to the annulus by fluids pumped down a central opening of the drill string. The system also includes means for actuating the valves either individually or in combination.

Each valve includes a valve body which is connected to the drill string and which has a longitudinal opening therethrough with at least one transverse port interconnecting the longitudinal opening and the annulus. A longitudinally slidable valve sleeve is positioned in the valve body and has a conical upper surface thereon. A replaceable seat is threaded into the valve body in a position above the valve sleeve and has a conical surface at the lower end thereof which conforms to the conical surface of the valve sleeve to sealingly close the transverse port when the valve sleeve is in a closed position. Packing is used to seal between the valve sleeve and an inner surface of the valve body.

Positioned below the valve sleeve is a valve plunger held in contact with the valve sleeve by a spring. The spring biases the plunger and sleeve upwardly toward a closed position of the valve sleeve.

An actuator is used to move the valve sleeve from its closed position to an open position so that fluid may be pumped downwardly through the central opening of the drill string and through the transverse port of the valve into the annulus. The actuator seats on the valve sleeve and forces it downwardly to an open position by hydraulic pressure. A plurality of actuators are used in the system, each actuator uniquely sized so that it will actuate a single valve in the drill string. The minimum central opening of each valve is progressively smaller from the uppermost valve to the lowermost. The actuator for a specific valve will pass through each valve in the drill string above the specific valve, but will engage the valve sleeve of the specific valve so that the valve will be opened.

Each actuator has an actuator body and an actuator cap defining a cavity therein in which is positioned a flow control valve. When the flow control valve is in a closed position, no fluid will be pumped below the actuator when it engages its corresponding valve, thus directing all fluid out the transverse port in the valve. When the flow control valve is in a variably open position, some fluid will be directed through a longitudinal passage in the actuator.

While the valve and actuator are disclosed herein for usage in a drill string, the configuration of the valve and actuator is adaptable to other usages, such as in the well production string.

The annulus access valve system of the present invention is ideally suited for preventing blowouts when there has been an entry of high pressure formation fluids into the well bore. The operator may open the desired valve in the drill string and pump an appropriate drilling fluid through the valve to contain the high pressure fluid. The high pressure fluid may then be circulated out of the well by conventional methods.

An important object of the invention is to provide a system for providing access to the annulus between a well bore and a drill string therein at selected depths along the drill string.

Another object of the invention is to provide a plurality of valves spaced along a drill string such that the valves are openable individually or in combination so that appropriate fluids may be pumped therethrough into the annulus.

A further object of the invention is to provide a valve which may be installed in a drill string and which has a longitudinally slidable valve sleeve for opeing and closing a transverse port therethrough.

Still another object of the invention is to provide a plurality of unique actuators for opening specific valves spaced along a drill string.

An additional object of the invention is to provide a method of quickly preventing blowouts in wells without removing or damaging the drill string therein.

Additional objects and advantages of the invention will become apparent as the following detailed description of the preferred embodiment is read in conjunction with the accompanying drawings which illustrate such preferred embodiments.

DETAILED DESCRIPTION OF THE PREFERRED EMBODIMENT

Figure 1:
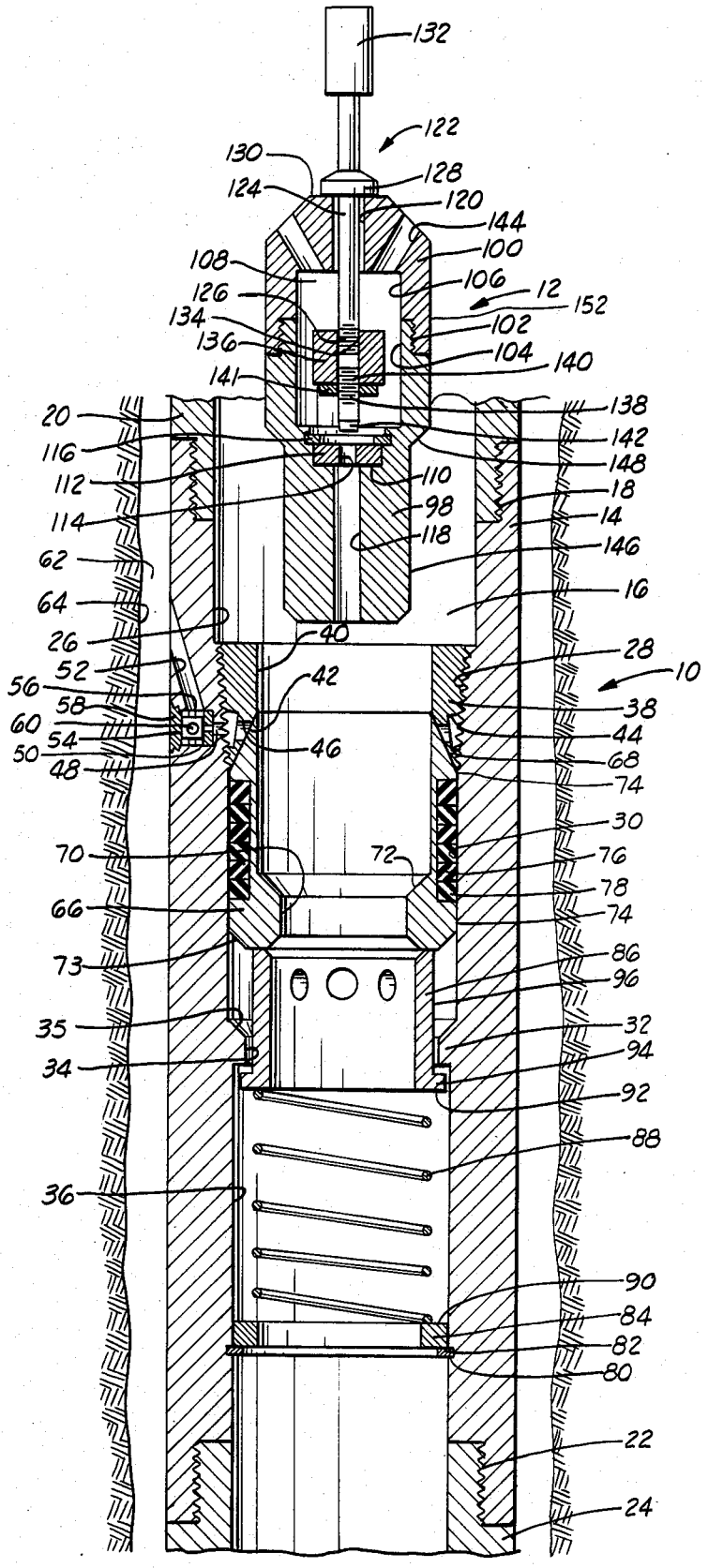
FIG. 1 shows the annulus access valve system of the present invention having a valve, shown in a closed position, forming a part of the drill string with an actuator for opening the valve.

Referring now to the drawings, and particularly to FIG. 1, the annulus access valve system of the present invention is shown in an open position and has a valve generally designated by the numeral 10 and an actuator generally designated by the numeral 12.

Valve 10 of the apparatus includes a valve body 14 having a central longitudinal opening 16 therethrough. Upper end 18 of valve body 14 is threadingly engaged to an upper portion 20 of the drill string in a manner known in the art. Similarly, a lower end 22 of valve body 14 is threadingly engaged with a lower portion 24 of the drill string.

Upper end 18 of valve body 14 defines an inner cylindrical surface 26. A straight, internal thread 28 is located immediately below cylindrical surface 26 and defines a diameter substantially less than that of cylindrical surface 26. A substantially cylindrical seal bore 30, having a diameter less than that of threaded surface 28, is disposed below the threaded surface. An inwardly extending shoulder 32, defining an inner cylindrical surface 34 and having an inner chamfer 35 on an upper surface thereof, separates seal surface 30 from another substantially cylindrical surface 36.

Replaceable seat 38, having a threaded outer surface, is threadingly engaged with threaded surface 28 of valve body 14. Seat 38 defines an inner cylindrical surface 40 at an upper end thereof and a conical surface 42 extending outwardly from cylindrical surface 40. In cross section, conical surface 42 preferably defines an acute angle from a longitudinal axis of valve body 14, but is not limited to such construction. Seat 38 further defines an outer recess 44 therearound. A plurality of transversely disposed holes 46 extend from conical surface 42 to outer recess 44.

A transverse hole 48 in valve body 14 extends radially outwardly from threaded surface 28 in alignment with recess 44 of seat 38. A counterbore 50, substantially concentric with transverse hole 48, is also located in valve body 14. Extending from counterbore 50 is an angularly disposed hole 52. An orifice 54 of a kind commonly known in the art is positioned in counterbore 50 adjacent transverse hole 48. A holddown cage 56 bears against orifice 54 and is held in place by threaded plug 58. Holddown cage 56 has a plurality of holes 60 therethrough such that at least one hole 60 is always in substantial alignment with angular hole 52 in valve body 14. Thus, holes 46, recess 44, hole 48, orifice 54, cage 56 and hole 52 define a substantially transverse port in valve 10 which provides communication between longitudinal opening 16 and annulus 62 formed between valve body 14 and well bore 64.

A valve sleeve 66 is longitudinally slidably received in seal surface 30 of valve body 14. Valve sleeve 66 has a conical, upper outer surface 68 which is dimensioned to conform to conical surface 42 of seal 38 and to sealingly close transverse holes 46 when valve sleeve 66 is in a closed position as shown in FIG. 1. Thus, seat 38 provides a seating means against which valve sleeve 66 seats and seals. Valve sleeve 66 also defines a central bore 70 therethrough with an inwardly chamfered surface 72. Further, valve sleeve 66 has an outwardly chamfered lower end 73. Outer surface 74 of valve sleeve 66 is dimensioned to be in close spaced relationship with seal surface 30 of valve body 14. Outer surface 74 has an annular recess 76 therein. Packing 78 of a kind known in the art is disposed in annular recess 76 for sealing between the recess and seal surface 30.

In one embodiment, a retainer ring groove 80 extends outwardly from cylindrical surface 36 adjacent lower end 22 of valve body 14, and a retainer ring 82 is positioned in the retainer ring groove. Located on retainer ring 82 is a spring seat 84. The apparatus is not limited to such construction; for example, retainer ring 82 and spring seat 84 could be replaced by a shoulder extending inwardly from cylindrical surface 36.

Positioned immediately below valve sleeve 66 in longitudinal opening 16 is a valve plunger 86 held in contact with the valve sleeve by a spring 88. Spring 88 bears against an upper surface 90 of spring seat 84 and against a lower surface 92 of an outwardly extending shoulder 94 of valve plunger 86. Spring 88 is always in compression such that valve plunger 86 is upwardly biased which in turn upwardly biases valve sleeve 66 toward its closed position. Cylindrical outer surface 96 of valve plunger 86 is dimensioned to be longitudinally slidingly received in cylindrical surface 34 of shoulder 32. Shoulder 94 of valve plunger 86 is positioned below shoulder 32. Valve sleeve 66 and valve plunger 86 are dimensioned such that shoulder 94 of the plunger never contacts the lower surface of shoulder 32 of valve body 14.

Actuator 12 of the present invention includes an actuator body 98 and an actuator cap 100 threadingly engaged thereto as indicated by reference number 102. Actuator body 98 defines a counterbored inner surface 104 and actuator cap 100 defines counterbored inner surface 106, such that the assembly of the actuator body and cap defines a cavity 108 therein.

At the lower end of cavity 108 is a small counterbore 110 in actuator body 98. An orifice seat 112 having a central opening 114 therethrough is disposed in counterbore 110 and held in place by retainer ring 116. Orifice 112 is positioned such that central opening 114 therein is aligned with a central longitudinal opening 118 in actuator body 98.

Actuator cap 100 has a central longitudinal opening 120 therein at an upper end thereof. A control rod 122 has an intermediate portion 124 disposed through opening 120 and a lower threaded portion 126. A flange 128 extends outwardly from intermediate portion 124 of control rod 122 above upper surface 130 of actuator cap 100, and flange 128 is dimensioned such that it cannot pass through opening 120. Control rod 122 has an upper portion 132 which forms a conventional fishing neck as commonly known in the art. Threaded portion 126 of control rod 122 is threadingly engaged with a threaded central opening 134 of adjusting nut 136 at an upper end thereof. A flow control valve 138 has a threaded upper end 140 threadingly engaged to a lower end of adjusting nut 136. Lock nut 141 holds flow control valve 138 in the desired position. Flow control valve 138 has a tapered lower end 142 which is dimensioned to seat in orifice seat 112 for sealing central opening 114 when the flow control valve is in a closed position.

Actuator cap 100 has a plurality of angularly disposed holes 144 through an upper end thereof in communication with cavity 108. Thus, it can be seen that angular holes 144 are placed in communication with central longitudinal opening 118 of actuator body 98 when flow control valve 138 is in an open position wherein its lower portion 142 is not seated on orifice seat 112. It will be seen that this open position is variable depending on the threaded position of control rod 122 and flow control valve 138 in adjusting nut 136.

As viewed in FIG. 1, valve sleeve 66 of valve 10 is in a closed position sealing transverse ports 46 in seat 38 from longitudinal opening 16. It will be obvious to those skilled in the art that when valve sleeve 66 is in this closed position, the exposed upper area of the top of the valve sleeve, essentially the exposed area of chamfered surface 72, is less than that of the exposed lower area. Thus, when pressurized fluid is present, the upwardly directed static pressure acting on valve sleeve 66 is greater than the downwardly directed static pressure which tends to keep the valve sleeve seated against seat 38. Preferably, the upper and lower exposed areas are sized such that the upward static pressure differential is greater than any downwardly directed dynamic pressure acting on valve sleeve 66 by fluid flowing down the drill string. Thus, intermittent unseating of the valve, known as "chatter", is avoided.

In FIG. 1, actuator 12 is positioned in longitudinal opening 16 as it would be when being lowered or dropped into the drill string for the purposes of opening the valve by downwardly displacing valve sleeve 66. Outer cylindrical surface 146 of actuator body 98 is dimensioned to fit within central bore 70 of valve sleeve 66. Chamfer 148 extends outwardly from surface 146 and is designed to engage and substantially seal against chamfered surface 72 of valve sleeve 66.

Figure 2:
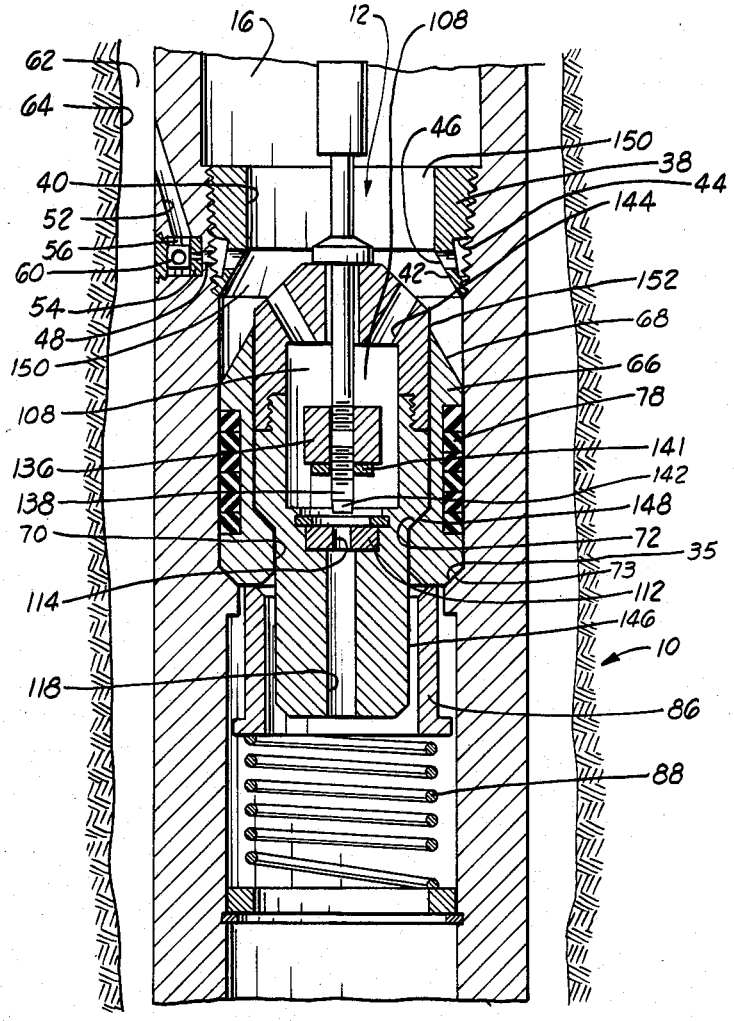
FIG. 2 illustrates the apparatus in which the actuator has engaged the valve and moved it to an open position.

FIG. 2 shows the apparatus of the present invention in an open position in which valve sleeve 66 is moved downwardly from conical surface 42 of seat 38 exposing transverse holes 46. Valve sleeve 66 stops against shoulder 32 with chamfer 73 of the sleeve being in substantially sealing contact with chamfer 35 of the shoulder. An open volume 150 is formed adjacent transverse holes 46 when the valve is opened. Thus, valve sleeve 66 provides annulus access means for allowing fluid pumped down the drill string into longitudinal opening 16 to pass through the substantially transverse port formed by holes 46, recess 44, hole 48, orifice 54, cage 56 and holes 52 into annulus 62 between valve portion 10 and well bore 64.

Prior to lowering or dropping actuator 12 into the drill string, the position of flow control valve 138 is preset by adjusting nut 136 and locked into position by lock nut 141. As shown in FIG. 2, flow control valve 138 is set in an open position so that it will never seat on orifice seat 112 allowing a portion of the fluid pumped down longitudinal opening 16 to pass through angular openings 144, into cavity 108, thence through openings 114 and 118 and on down the drill string as desired. This procedure will be further described hereinafter.

When actuator 12 contacts valve sleeve 66, valve plunger 86 is downwardly displaced to compress spring 88. When actuator 12 is removed, spring 88 will exert an upward force on valve plunger 86 to act as a valve return means for returning valve sleeve 66 to the original, closed position.

A plurality of annulus access valves of the present invention may be installed in a drill string at any desired point. When this is done, the central bore 70 of each valve sleeve 66 is progressively smaller from the uppermost valve 10 to the lowermost. A plurality of actuators 12 are sized such that a single, unique actuator is utilized to open a corresponding valve 10 in the drill string. In other words, outer surface 152 of actuator 12 designed for actuating valve sleeve 66 in the lowermost valve 10 in the drill string is sized to pass through central bore 70 of the valve 10 located above the desired valve. Therefore, the operator of the apparatus may select which specific valve 10 or which specific combination of such valves to open.

Although the valve 10 and actuator 12 are shown for usage in the annulus access sytem of the present invention, it will be obvious to those skilled in the art that the configuration of valve and actuator is adaptable to other usages, such as in the well production string.

OPERATION OF THE APPARATUS

The annulus access control of the present invention is ideally suited for blowout prevention. As is well known, a blowout occurs when there is an uncontrolled flow of well fluids into the atmosphere or when there is such an uncontrolled flow into a low pressure formation in the well bore. Either of these is an extremely dangerous and undesirable situation, particularly when gas is involved, and accordingly, well operators make every effort to prevent a blowout from happening.

Figure 3:
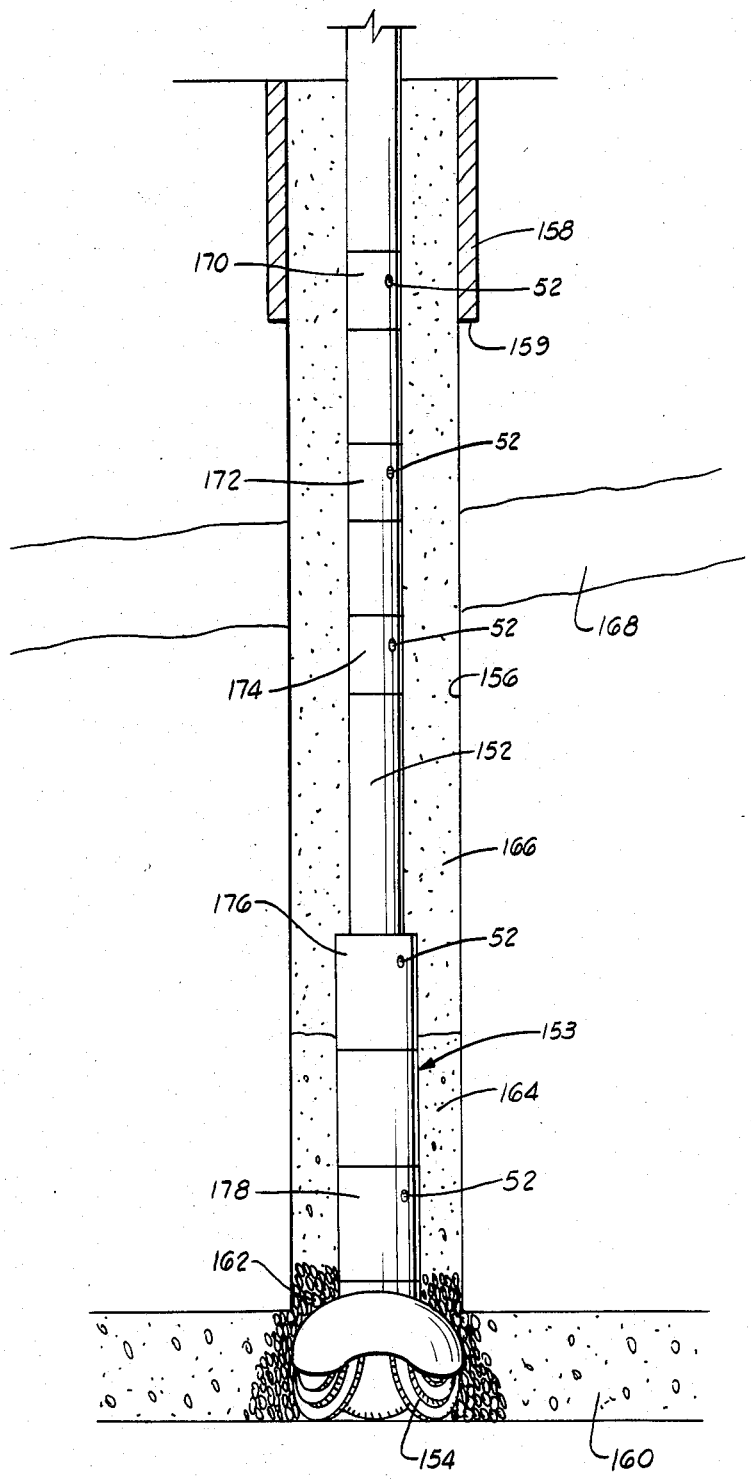
FIG. 3 shows the valve system in place in a drill string positioned in a well bore where a kick and pack-off have occurred.

Generally, the first step that may possibly lead to a blowout is when the drill bit enters a high pressure formation and there is an entry of water, gas, oil, or other formation fluids into the well bore, commonly referred to as a "kick". This occurs because the pressure exerted by the column of drilling fluid in the annulus between the drill string and well bore is not great enough to overcome the pressure exerted by the fluids in the high pressure formation. If prompt action is not taken to control the kick, a blowout will occur. A typical example of such a situation is illustrated at FIG. 3. A drill string 152 has a larger diameter drill collar portion 153 with a bit 154 at the lower end thereof, and the drill string is in a well bore 156. Casing 158 is shown at the upper portion of well bore 156. The lower end of casing 158 defines a casing shoe 159. As shown in FIG. 3, drill bit 154 has entered a high pressure formation 160. Gas in the formation has blown sand and rock into the well bore as indicated by numeral 162, locking the drill string and preventing rotation thereof. This is commonly referred to as a "packoff". The danger of such a situation arises when a high pressure gas bubble 164 enters the well bore from high pressure formation 160. Such a gas bubble 164 will eventually migrate up the well bore through drilling mud 166. A blowout can occur when gas bubble 164 reaches a low pressure formation, such as that indicated by numeral 168, and spreads uncontrollably therethrough or when the gas bubble reaches casing shoe 159 or the top of the well and uncontrollably escapes to the atmosphere.

When a packoff occurs, this is immediately known at the surface, because the drill string ceases to rotate and the pressure of the mud pumps increases dramatically. The object of blowout prevention is to control and contain the gas bubble so that it may be gradually expanded to a low pressure, at which point it is no longer a danger. In normal blowout prevention procedures, it is first necessary to perforate the drill string as near to the bit as possible, or back off the drill string as near the bit as possible. After this is done, heavy mud is pumped down the drill string into the well bore to help control the formation pressure which caused the "kick". The heavy mud forms a column of fluid exerting hydrostatic pressure on formation 160. This hydrostatic pressure plus pressure from the mud pumps and back pressure from a choke at the top of the well exert sufficient total pressure at the bottom of well bore 156 to prevent further entry of gas from formation 160. The disadvantage of these conventional techniques is that it takes time to lower a perforation charge into the drill string or to back off the drill string near the bit. Also, perforation destroys part of the drill string.

FIG. 3 shows drill string 152 as having five valves 10 of the present invention installed therein. These valves are identified from top to bottom by reference numerals 170, 172 and 174 in the upper portion of drill string 152 and valves 176 and 178 in drill collar portion 153. Although five valves are illustrated, the system is not limited to such a number, and any number of valves may be installed as desired and as conditions dictate. The advantage of the system over prior blowout prevention techniques is that a valve is already present in the drill string through which mud may be pumped to control the kick and work it out of well bore 156 when drill bit 154 is plugged. For the example of FIG. 3, the appropriate actuator 12 sized for valve 178 is lowered into the hole, and fluid is pumped down the drill string to hydraulically force that actuator against valve sleeve 66 in valve 178 to move the valve sleeve downwardly to its open position, exposing transverse holes 46 as hereinbefore described. The pressure on the fluid then causes the fluid to be pumped through hole 52 and out into the annulus between drill string 152 and well bore 156 wherein it acts to contain the formation pressure so gas bubble 164 may be worked out. Thus, the operator is able to take action to prevent a blowout much more quickly than with conventional techniques. Also, there is no destruction of the drill string as when a perforation technique is utilized. After the operator has controlled the formation pressure, gas bubble 164 may be expanded and circulated out of the well in any conventional manner previously known in the art.

The quickness of controlling formation pressures with the present invention may be of particular importance in offshore installation where reaction time is much shorter.

In cases where lowermost valve 178 is also covered by the packoff, the operator can lower the appropriate actuator 12 for valve 176 and pump fluid therethrough to control the formation pressure. Again, with this access to the annulus, high pressure gas bubble 164 may then be circulated out of the well by conventional methods.

Once high pressure gas bubble 164 has been circulated out of the well, and the well is safe, the various actuation portions 12 may be fished out of the well. At this time, the packoff or plugged bit is corrected by conventional methods known in the art.

Normally, in the above-described procedures of the use of the annulus access valve system, flow control valve 138 is adjusted so that it will close hole 114 in seat 112. In other words, no fluid pumped down the hole to force the actuator to open valve sleeve 66 will be allowed to continue further down the central opening of the drill string.

However, sometimes the bit will not be totally packed off and rotation of the drill bit will still be possible. By preadjusting flow control valve 138 to remain in an open position as shown in FIG. 2, a portion of the fluid may still be pumped down drill string 152 below actuator 12 to bit 154. Thus, the system includes a selectable fluid flow control means for allowing some fluid to continue down the drill string while diverting the remainder of the fluid through the transverse port of the valve. Although there is obviously a reduced volume of fluid pumped to the bit, it will still be possible to rotate the drill string and continue drilling. At a convenient time, actuator 12 may be fished out of the well in a manner commonly known in the art. When the pressure above actuator 12 is relieved, the corresponding valve sleeve 66 is automatically returned to its closed position by spring 88 as hereinbefore described.

The apparatus also provides the operator with the ability to inject different fluids known in the art into annulus 62 adjacent the gas bubble formed by a kick for the purpose of chemically and/or physically changing the natural gas.

Because the operator may select which valve in the drill string to open, different fluids may be pumped through different valves as desired. For example, but not by way of limitation, a heavy fluid might be pumped through valve 178 in FIG. 3 to fill a portion of the annulus between drill string 152 and well bore 156. A lighter fluid might be then added through valve 174 so that the heavy fluid is not adjacent, and thus could not enter, low pressure formation 168.

The flexibility of the annulus access valve system of the present invention also may be used for a variety of other purposes. For example, the valves are useful in tripping pipe wherein they may be used as an aid to clear an obstruction in the hole so that the bit may be passed therethrough. Abrasive materials of a kind known in the art may be pumped through the valves to cut out a key seat so that the drill bit may be removed. It can be seen that such flexibility will many times eliminate partial removal of the drill string and a fishing operation.

It can be seen, therefore, that the annulus access valve system of the present invention is well adapted to carry out the objects and attain the ends and advantages mentioned, as well as those inherent therein. While a presently preferred embodiment of the apparatus of the invention and several preferred methods of use have been described for the purposes of this disclosure, numerous changes in the construction and arrangement of parts in the apparatus, and variations in method of use, can be made by those skilled in the art. All such changes and variations are encompassed within the scope and spirit of this invention as defined by the appended claims.

What is claimed is:

1. An annulus access apparatus for use in a drill string positioned in a well bore, said apparatus comprising:

a valve adapted for fitting in said drill string and defining a longitudinal opening therethrough and a substantially transverse port therein for interconnecting said longitudinal opening with an annulus formed between said valve and said well bore, said valve including annulus access means for placing said transverse port in communication with said longitudinal opening when in an open position and covering said transverse port when in a closed position;

a retrievable actuator movable through a central opening of said drill string for moving said annulus access means from said closed position to said open position and having selectable fluid flow control means for alternately preselecting one of a closed position thereof, in which fluid pumped through said drill string will be totally diverted through said transverse port in said valve when said annulus access means is in said annulus access means open position, and a preset open position thereof, in which a portion of said fluid is diverted through said transverse port in said valve with a remaining portion of said fluid continuing downwardly through said central opening of said drill string below said valve; and return means for returning said annulus access means to said closed position when said actuator is retrieved from said valve.

2. The apparatus of claim 1 wherein said valve further comprises seating means, through which extends at least a portion of said transverse port, for sealing contact with said annulus access means when said annulus access means is in said closed position.

3. The apparatus of claim 2 wherein:

said annulus access means comprises a valve sleeve longitudinally movable in said valve and having a conical surface at an upper end thereof; and said seating means comprises a valve seat disposed in said valve above said valve sleeve and having a conical surface at a lower end thereof, said conical surface of said valve seat conforming to said conical surface of said valve sleeve such that sealing contact is made between said conical surfaces when said valve sleeve is in said closed position.

4. The apparatus of claim 3 wherein said valve seat is replaceable.

5. The apparatus of claim 3 wherein said valve further comprises:

a valve body connected to said drill string and defining an inner, sealing surface therein; and packing means for sealing between said valve sleeve and said sealing surface of said valve body.

6. The apparatus of claim 1 further comprising an orifice of predetermined size disposed in said transverse port.

7. The apparatus of claim 6 wherein said orifice is replaceable.

8. The apparatus of claim 1 wherein said return means is characterized as a spring disposed in said valve for biasing said annulus access means toward said closed position.

9. The apparatus of claim 1 wherein:

said actuator defines a substantially longitudinal passage therethrough; and said fluid flow control means is characterized as a flow control valve disposed within said passage for preventing fluid flow therethrough when in said closed position and allowing fluid flow therethrough when in said variably open position.

10. An annulus access system for use in a well comprising:

a plurality of spaced-apart valves positioned in a drill string, each of said valves comprising:

a valve body forming a part of said drill string, said valve body defining a longitudinal opening therethrough in communication with a central opening of said drill string and a transverse port therein interconnecting said longitudinal opening with an annular volume formed between said valve body and a wall of said well;

a longitudinally slidable valve sleeve disposed in said longitudinal opening of said valve body and having a conical surface at an upper end thereof, said valve sleeve defining a closed position covering said transverse port and an open position, and further defining a central opening therethrough;

a seat disposed in said valve body and above said valve sleeve, said seat having a conical surface at a lower end thereof and defining a transverse opening therethrough in communication with said transverse port in said valve body, said conical surface of said seat conforming to said conical surface of said valve sleeve such that a seal is formed between said conical surfaces when said valve sleeve is in said closed position, thereby covering said transverse opening in said seat and closing said transverse port adjacent said longitudinal opening; and valve return means for biasing said valve sleeve in said closed position;

wherein, said central opening of any specific valve is smaller than said central opening of any other valve located above said specific valve in said drill string;

a plurality of retrievable actuators, positionable in central opening of said drill string and corresponding to valves, at least one of said actuators defining a substantially longitudinal fluid passage therethrough and comprising:

a flow control valve disposed in said fluid passage for controlling fluid flow therethrough;

wherein, each of said actuators is sized for selectively actuating a specific valve in said drill string and is free to pass through said central opening of any valve sleeve of a valve located above said specific valve but will contact said valve sleeve of said specific valve and move it to said open position when sufficient hydraulic pressure is applied thereabove.

11. The system of claim 10 wherein said seat is replaceable.

12. The system of claim 10 wherein each of said valve bodies defines an inner, sealing surface; and said system further comprises packing for sealing between each of said valve sleeves and said respective sealing surfaces of said valve bodies.

13. The system of claim 10 further comprising an orifice of predetermined size in each of said transverse ports of said valves.

14. The system of claim 10 wherein said valve return means of each of said valves is characterized as a spring.

15. The system of claim 10 wherein said flow control valve is adjustable and defines a closed position of said fluid passage and a variably open position.

16. A method of preventing a blowout in a well having a drill string therein, said method comprising the steps of:

pre-installing a plurality of spaced apart valves in said drill string, each of said valves defining a port therein for interconnecting a central opening of said drill string with an annulus formed between said drill string and a bore of said well when said port is opened, each of said ports being normally closed;

opening said port of at least one of said valves adjacent an area of intrusion of high pressure fluid in said annulus;

pumping an appropriate fluid through said open port of said valve for preventing further intrusion of said high pressure fluid into said annulus; and circulating said high pressure fluid from said annulus.

17. The method of claim 16 further comprising the step of directing a portion of said appropriate fluid downwardly from said valve toward a bit on said drill string for continued rotation of said drill string while pumping said appropriate fluid through said open port.

* * * * *